US007628300B2

(12) United States Patent
Minamimura et al.

(10) Patent No.: US 7,628,300 B2
(45) Date of Patent: Dec. 8, 2009

(54) METHOD FOR PREVENTING LEAKING OF MOLTEN METAL IN INJECTION MOLDING OF METAL MATERIAL

(75) Inventors: Masaaki Minamimura, Nagano-ken (JP); Yasuhiko Takeuchi, Nagano-ken (JP); Toshiyasu Koda, Nagano-ken (JP); Mamoru Miyagawa, Nagano-ken (JP); Ikuo Uwadaira, Nagano-ken (JP); Taku Kawano, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 0 days.

(21) Appl. No.: 12/286,862

(22) Filed: Oct. 2, 2008

(65) Prior Publication Data

US 2009/0090749 A1 Apr. 9, 2009

(30) Foreign Application Priority Data

Oct. 3, 2007 (JP) ..... 2007-260069

(51) Int. Cl.
*B22D 37/00* (2006.01)

(52) U.S. Cl. ..... 222/590; 222/594

(58) Field of Classification Search ..... 222/590, 222/591, 594–602
See application file for complete search history.

(56) References Cited

FOREIGN PATENT DOCUMENTS

| | | |
|---|---|---|
| JP | 2001079653 | 3/2001 |
| JP | 2004122141 | 4/2004 |
| JP | 2004-322200 | * 11/2004 |
| JP | 2004322200 | 11/2004 |
| JP | 2007038233 | 2/2007 |

* cited by examiner

*Primary Examiner*—Scott Kastler
(74) *Attorney, Agent, or Firm*—Weingarten, Schurgin, Gagnebin & Lebovici LLP

(57) ABSTRACT

A method of preventing leaking of molten metal from a nozzle in an injection apparatus comprising, metering the molten metal by travel of a plunger head backward from a most forward position to a most backward position at the rear of a supply opening while maintaining nozzle contact after completion of an injection step and supplying molten metal from a furnace into a cylinder body through the supply opening, after completion of the metering, closing the supply opening by travel of the plunger head forward at a low speed from the backward position to a stand-by position ahead of the supply opening for cutting off the communication between the molten metal in the cylinder body and the molten metal in the furnace.

4 Claims, 3 Drawing Sheets

METHOD FOR PREVENTING LEAKING OF MOLTEN METAL IN INJECTION MOLDING OF METAL MATERIAL

This application claims priority to Japanese Patent Application No. 2007-260069, filed on Oct. 3, 2007.

BACKGROUND OF THE INVENTION

1. Field of the Invention

The present invention relates to a method for preventing leaking of molten metal in an injection apparatus for metal molding wherein a metal material is supplied as molten metal from a metal material melting and holding furnace into an injection cylinder with a plunger installed therein and both metering and injection of the molten metal are performed by the plunger.

2. Description of the Related Art

When a nozzle installed at a tip of an injection cylinder is touched to a cooled mold to inject molten metal from the injection cylinder into the mold and nozzle touching is continued also after the injection, the nozzle is cooled by coldness transmitted from the mold and the molten metal remaining within the nozzle solidifies to form a metal plug referred to as cold plug. The interior of the nozzle tip is closed with the cold plug and therefore even if the nozzle is separated from the mold, there will not occur any leak of molten metal from the nozzle tip insofar as the separation of the nozzle is after formation of the cold plug (refer to Japanese Patent Publication No. 2001-79653).

On the other hand, if the cold plug is formed to excess, it would be difficult to remove the cold plug even if an injection pressure is applied thereto, thus inducing a large injection resistance. To avoid such excessive formation of the cold plug, the nozzle temperature is controlled or the nozzle tip temperature and the plug forming temperature are calculated in a comparative manner and the nozzle travels backward when the calculated value is within an allowable range (refer to Japanese Patent Publication No. 2004-122141). There also has been proposed a technique of heating the nozzle at the time of injection to soften the environs of the cold plug, thereby permitting the cold plug to be removed more easily by the injection pressure (refer to Japanese Patent Publication No. 2004-122141).

As means for preventing backflow and leak of molten metal supplied into an injection cylinder there have been proposed means wherein a check valve assembly is installed in a molding material communication conduit which is for the supply of molten metal to an injection cylinder (refer to Japanese Patent Publication No. 2004-322200) and means wherein an intermediate shaft portion of a plunger is formed in a valve for opening and closing a supply opening and it closes the supply opening during travel of the plunger up to its most forward position, thereby preventing backflow to a supply path under the action of a dwell force (refer to Japanese Patent Publication No. 2007-38233).

SUMMARY OF THE INVENTION

The formation of the cold plug with coldness transmitted from the mold is not always the same. Consequently, there sometimes occurs a case where the formation of the cold plug is insufficient even if the nozzle heating temperature is controlled process by process from the injection process which starts after nozzle touching up to a forward travel process of an injection unit via a backward travel process of the injection unit and a metering process or even if the state of formation of the cold plug is checked from a calculated value and a backward travel of the nozzle is performed. In this case, leak of molten metal may occur from the nozzle tip. In case of the metal material being a magnesium alloy, a dangerous situation such as burning of leaking molten metal due to spontaneous ignition thereof, may occur.

The amount of molten metal leaking from the nozzle tip differs depending on the construction of an injection apparatus, but in the case of an injection apparatus wherein molten metal is gravitationally supplied from a melting and holding furnace into an injection cylinder through a supply opening and metered, a backward position of a plunger head is set to a more rear position than the supply opening, so also after metering, the melting and holding furnace and the injection cylinder are in communication with each other by the supply opening and maintain the state of molten metal supply. Since the molten metal present within the cylinder is in a pressurized state by the load of molten metal held within the melting and holding furnace, it is apt to leak from the nozzle tip if the formation of the cold plug is insufficient and this leak is not only of the metered molten metal present within the cylinder but also of the molten metal held within the melting and holding furnace. Consequently, the amount of molten metal leaking from the nozzle tip tends to become large.

A means for preventing the influence of this leak on the molten metal held within the melting and holding furnace may be the provision of a valve mechanism such as a check valve or a shut-off valve within the molten metal supply path as in the prior art. In this case, however, there arise various mechanical problems such as, for example, complication of the interior structure of the supply path due to installation of the valve mechanism, obstruction to flowing due to deposition of molten metal on the valve mechanism and whether the valve mechanism is durable enough against the high temperature of molten metal. Besides, since the valve mechanism is required to satisfy high-temperature specifications, high price and increase of cost result. Thus, the provision of the valve mechanism involves such economic problems in the molding machine.

It is an object of the present invention to provide a new method wherein the leak of molten metal from the nozzle tip in the above injection apparatus equipped in the interior thereof with the plunger can be prevented easily not by controlling the nozzle temperature or installing the valve mechanism but by operating the travel of the plunger.

According to the present invention, for achieving the above-mentioned object, there is provided a method for preventing leaking of molten metal material in injection molding of a metal material;

- injection apparatus comprising:
  - an injection cylinder comprising:
    - a cylinder body having an interior space including a nozzle at a front end of the cylinder body,
    - a supply opening formed in an upper portion of the cylinder body,
  - an injection plunger inserted into the cylinder body interior space for forward and backward travel, and having a plunger head for traveling from a backward position at the rear of the supply opening up to a most forward position(B), and
  - a furnace for melting and holding a metal material, said furnace provided on a top portion of the injection cylinder and having an outlet at a bottom end of the furnace communicated with the supply opening;
- wherein the method comprises the steps of:
  - metering the molten metal by travel of the plunger head backward forcibly from the most forward position to the backward position while maintaining nozzle touching after completion of an injection step and supplying the molten metal from the furnace into the cylinder body through the supply opening, after completion of the metering, closing the supply opening by travel of the plunger head forward at low speed from the backward position to a stand-by position ahead of the supply opening for cutting off the communication between the molten metal in the cylinder body and the molten metal in the furnace to prevent leaking of the molten metal from the nozzle.

The forward traveling speed of the plunger head from the backward position to the stand-by position is as low as 10 to 100 mm/s and the process from the start of metering the molten metal up to closing the supply opening by the plunger head is carried out while maintaining nozzle touching by interlocking which inhibits travel of the injection apparatus.

The plunger head is stopped at the stand-by position for positioning control, then the plunger travels forward at predetermined injection speed and injects the metered molten metal.

EFFECTS OF THE INVENTION

According to the above method, after metering, the plunger head travels forward to close the supply opening and the closing of the supply opening by the plunger head is maintained until shift to the injection process. This is all that is required and thus the leak of molten metal from the nozzle can be prevented in a simple manner without the need of any other special operation. Besides, there is no increase of cost because it is not necessary to use any means such as a valve mechanism for preventing the influence of leak on the molten metal held within the melting and holding furnace. Moreover, since the blocking of the supply opening caused by the deposition of molten metal is hard to occur, the supply of molten metal by gravity can be done smoothly over a long period.

Since the forward travel of the plunger head is done at low speed, there is only a little influence on the cold plug even if molten metal is pressurized and leak of molten metal from the nozzle caused by forward travel of the plunger head after metering does not occur. Further, by closing of the supply opening, the communication between the molten metal present within the cylinder body and the molten metal held within the melting and holding furnace is cut off and the load which the molten metal present within the cylinder body bears becomes nil, so that the molten metal is prevented from leaking easily from the nozzle under that load, and even if there occurs leak of molten metal from the nozzle, the leak is of only the molten metal present within the cylinder body and not of the molten metal held within the melting and holding furnace. Thus, it is possible to prevent a large amount of molten metal from leaking from the nozzle.

In the process from the start of metering up to closing of the supply opening by the plunger head, nozzle touching is maintained by interlocking which inhibits travel of the injection apparatus. Thus, even if an attempt is made to isolate the nozzle by mistake during metering, leak of molten metal from the nozzle can be prevented positively because nozzle touching is maintained by interlocking.

DESCRIPTION OF THE PREFERRED EMBODIMENT

Figure 1:
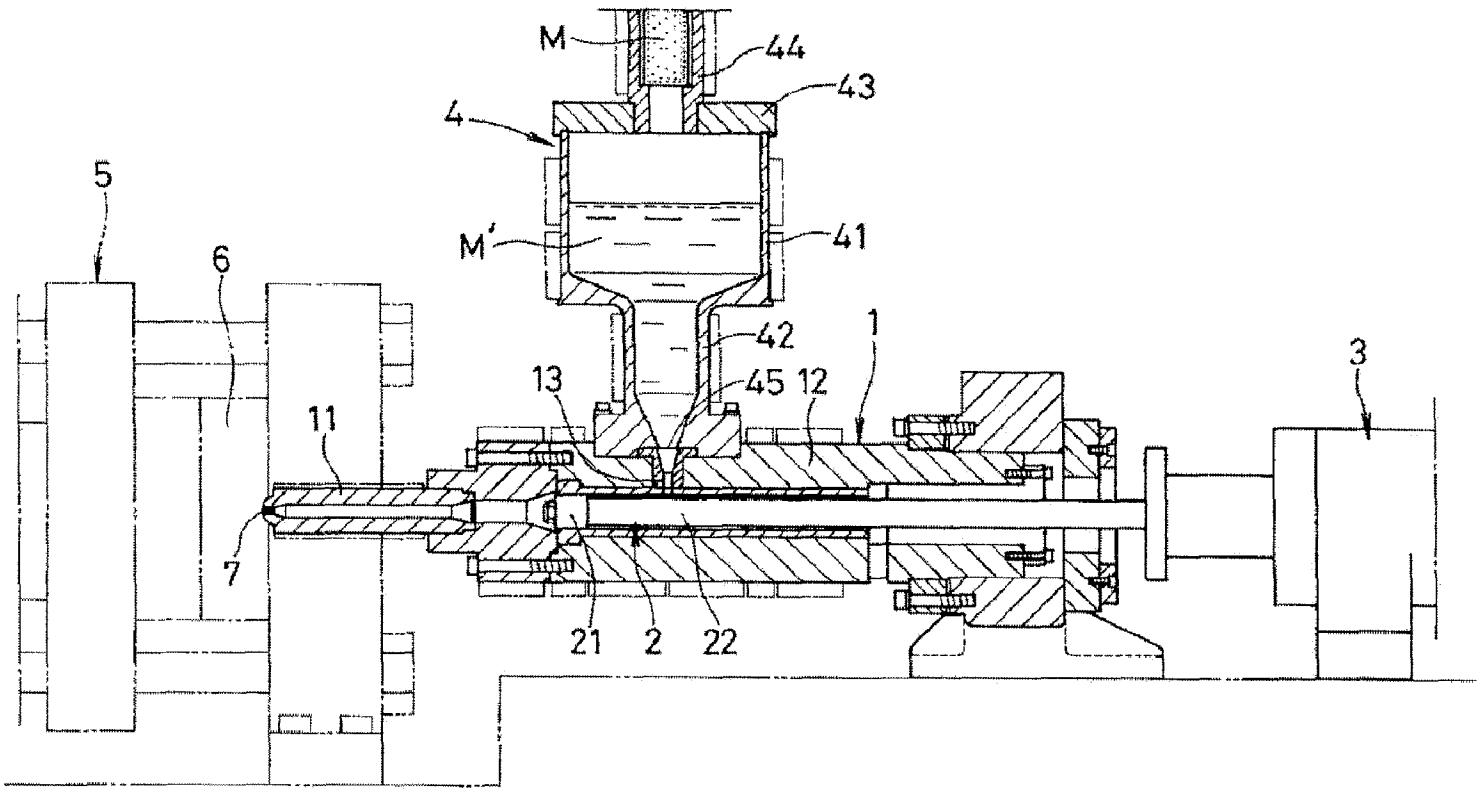
FIG. 1 is a side view in longitudinal section of an injection apparatus for metal molding to which the present invention is applicable.
Figure 2:
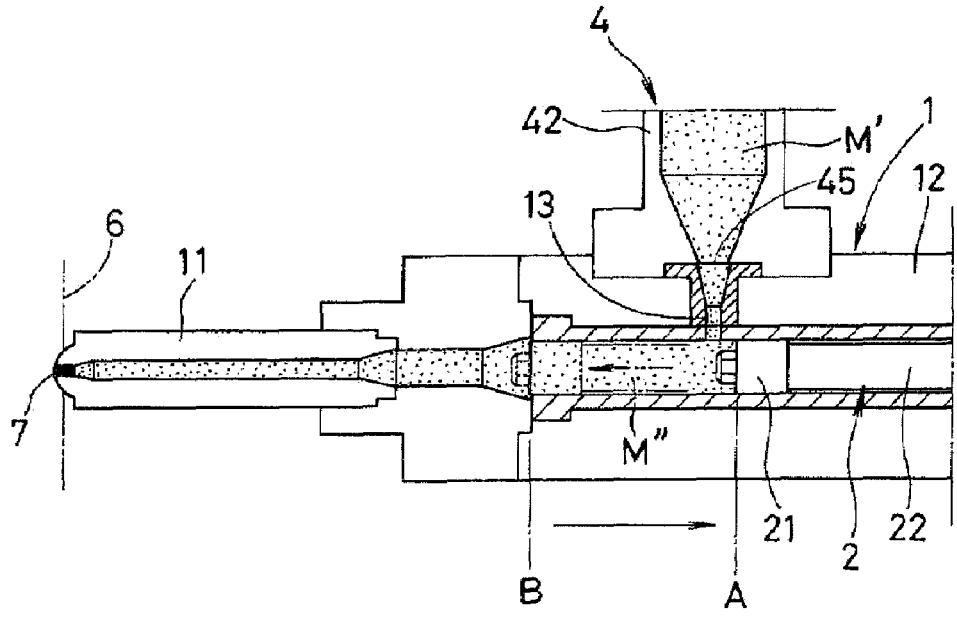
FIG. 2 is a diagram explanatory of material metering by backward travel of a plunger head.

In the drawings, the reference numeral 1 denotes an injection cylinder. The injection cylinder 1 includes a cylinder body 12 having a nozzle 11 at a tip thereof and a plunger 2 disposed in the interior of the cylinder body 12 so as to be capable of traveling forward and backward. The plunger 2 is made up of a plunger head 21 and a plunger rod 22 connected to an injection drive unit 3 located behind the injection cylinder. The plunger head 21 is adapted to travel from a backward position A up to a most forward position B, the backward position A being located at the rear of a supply opening 13 formed in a front upper position of the cylinder body 12 (see FIG. 2). Heating means using band heaters are mounted on outer peripheries of the nozzle 11 and the cylinder body 12 so that the temperature of each heater can be controlled individually.

Numeral 4 denotes a melting and holding furnace for a metal material. The melting and holding furnace 4 includes a furnace body 41, a storage cylinder 42 integral with a bottom of the furnace body 41, and a material supply cylinder 44 inserted at a lower end thereof into a lid member 43 of the furnace body 41 and erected on the furnace body. The melting and holding furnace 4 is installed on the injection cylinder 1 in a state in which a lower-end opening 45 of the storage cylinder 42 is connected to the supply opening 13. A plurality of band heaters are mounted as heating means on outer peripheries of the furnace body 41 and the storage cylinder 42 in such a manner that the temperature of each heater can be controlled individually.

In the melting and holding furnace 4 thus constructed, a rod-like metal material M (e.g. a magnesium base alloy) is melted in the material supply cylinder 44 into molten metal M', which is stored in a set amount (e.g. 10 Kgf/50 shots) into both furnace body 41 and storage cylinder 42. The molten metal M' thus stored flows into the cylinder from the opened supply opening 13 by gravity when the plunger head 21 is at its backward position A.

In the injection apparatus of the above construction, the injection apparatus travels forward after a mold clamping process and the nozzle 11 is touched to a cooled mold 6, thereafter, metered molten metal M" in the cylinder body is pressurized by forward travel of the plunger head 21 and is injected from the nozzle 11 and filled into the mold 6 attached to a mold clamping unit 5. When completion of the injection is confirmed, the plunger head 21 travels backward while maintaining nozzle touching and metering is started. This backward travel is performed by travel of the plunger head 21 up to the backward position A.

At the nozzle tip portion, the remaining material becomes a cold plug 7 with coldness transmitted from the mold 6 by nozzle touching and blocks the interior of the nozzle tip. As a result of this blocking of the nozzle with the cold plug 7 the interior of the cylinder body becomes negative in pressure during travel of the plunger head 21 from the most forward position B up to the backward position A, but this negative pressure does not obstruct the backward travel because it is lower than the forced backward traveling force of the plunger head 21.

As a result of the supply opening 13 being opened in the manner described above the interior of the cylinder body 12 and that of the storage cylinder 42 come into communication with each other and the molten metal M' flows from the melting and holding furnace 4 into the cylinder body 12 by gravity. With this admission of the molten metal, the air present within the cylinder body 12 escapes into the melting and holding furnace 4, so that the interior of the cylinder body 12 is filled with the molten metal, whereby the molten metal M" of one shot is metered. During this metering operation the injection apparatus travels backward and is interlocked to prevent the occurrence of nozzle separation.

After the metering is over, both of completion of the metering and formation of the cold plug 7 are confirmed, followed by nozzle separation from the mold 6 by backward travel of the injection apparatus. However, if the formation of the cold plug 7 is insufficient, the metered molten metal M" in the cylinder body 12 may leak from the nozzle after nozzle separation because it undergoes the load of the molten metal M' in the melting and holding furnace 4. Therefore, the supply opening 13 is closed with the plunger head 21 before nozzle separation to cut off communication between the interior of the cylinder body 12 and that of the melting and holding furnace 4, and then nozzle separation is performed by backward travel of the injection apparatus.

Figure 3:
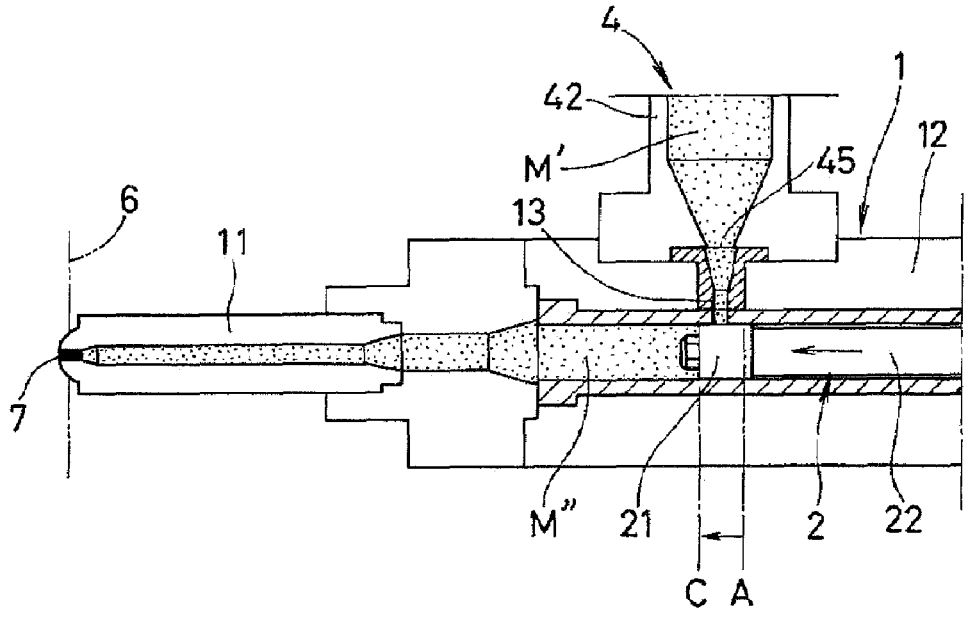
FIG. 3 is a diagram explanatory of closing of a supply opening by forward travel of the plunger head.
Figure 4:
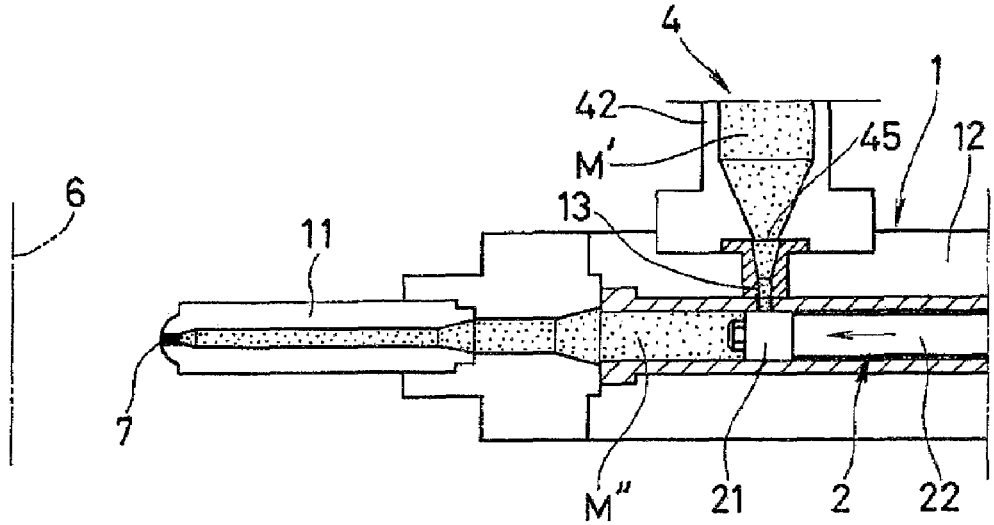
FIG. 4 is a diagram explanatory of closing of the supply opening by the plunger head at the time of nozzle separation.

As shown in FIG. 3, the closing of the supply opening 13 with the plunger head 21 is performed by forward travel of the plunger head 21 at the distance from the backward position A to a preset stand-by position C ahead of the supply opening 13, at least, the distance at which the supply opening 13 is closed with the plunger head 21. If this forward travel is performed at an injection speed (1000 to 4000 mm/s), the metered molten metal M" is oppressed instantaneously even if the travel distance of the plunger head 21 from the backward position A up to the stand-by position C is very short (e.g. 10 to 30 mm), and as a reaction thereof the metered molten metal M" flows backward into the melting and holding furnace 4, causing variations in metering. Besides, the urging force imposed on the cold plug 7 becomes unbalanced due to such variations in metering and variations occur also in the state of formation of the cold plug 7. Therefore, the forward travel of the plunger head 21 is performed at such a low speed (10 to 100 mm/s) as does not cause a backflow.

By forward travel of the plunger head 21 in the nozzle-touched state and at a low speed, the cold plug 7 is pushed without being oppressed, so that the state of formation of the cold plug 7 becomes stable and variations in metering for each shot are reduced.

After the forward travel, the plunger head 21 is stopped at its stand-by position C and there is performed a positioning control. After the plunger head 21 stops at the stand-by position C, the injection apparatus is released from its interlocked state, travels backward up to a set position and stops at the backward position until completion of the molding clamping process. Also after metering, the plunger head 21 stops at the stand-by position C to keep the supply opening 13 closed, whereby the leak of molten metal from the nozzle is prevented.

Even in the event of occurrence of any trouble with the cold plug 7 for example due to a failure of a heating control circuit provided at the nozzle tip, resulting in leak of molten metal, the leak is within the metering range and does not lead to leak of the molten metal M' held within the melting and holding furnace 4. Therefore, even in the event of occurrence of any unforeseen trouble in the nozzle portion, the amount of molten metal leaking from the nozzle can be diminished by closing of the supply opening 13 with the plunger head 21.

Interlocking is required to inhibit travel of the injection apparatus during the period from the start of metering until closing of the supply opening 13 with the plunger head 21. For example, by adopting a construction wherein the travel of the injection apparatus is allowed (interlock is released) only when a stand-by signal is ON which signal is generated in a positioning-controlled state with the plunger head 21 stopped at the stand-by position C, the travel of the injection apparatus is performed always in a closed state of the supply opening and thus this construction is preferred.

After completion of the mold clamping process, the injection apparatus travels forward and the nozzle touches the mold 6, whereupon the plunger head 21 travels forward at the above described high injection speed, and injects and fills the metered molten metal M" into the mold 6.

What is claimed is:

1. A method for preventing leaking of molten metal material in an injection apparatus for metal material molding, the injection apparatus comprising:

an injection cylinder comprising:

a cylinder body having an interior space including a nozzle at a front end of the cylinder body, a supply opening formed in an upper portion of the cylinder body, an injection plunger inserted into the cylinder body interior space for forward and backward travel, and having a solid plunger head for traveling from a backward position rearward of the supply opening up to a most forward position forward of the supply opening and blocking said supply opening, and a furnace for melting and holding a metal material, said furnace provided on a top portion of the injection cylinder and having an outlet at a bottom end of the furnace in communication with the supply opening;

the method comprising the steps of:

metering injection of the molten metal into the interior space by travel of the plunger head backward forcibly from the most forward position to the backward position while maintaining nozzle touching after completion of an injection step to allow a metered amount of the molten metal from the furnace into the cylinder body through the supply opening under the influence of a reduced pressure in the interior space forward of the plunger head due to formation of a cold plug at a tip of the nozzle, after completion of the metering, closing the supply opening by travel of the plunger head forward at low speed from the backward position to a stand-by position ahead of the supply opening for cutting off the connection between the molten metal in the cylinder body and the molten metal in the furnace from each other to prevent leaking of the molten metal from the nozzle tip by maintaining the cold plug.

2. The method according to claim 1, wherein the forward traveling speed of the plunger head from the backward position to the stand-by position is as low as 10 to 100 mm/s.

3. The method according to claim 1, wherein the process from the start of metering the molten metal up to closing the supply opening by the plunger head is carried out while maintaining nozzle touching by interlocking which inhibits travel of the injection apparatus.

4. The method according to claim 1, wherein the plunger head is stopped at the stand-by position for positioning control, then the plunger travels forward at a predetermined injection speed and injects the metered molten metal.

* * * * *